US009364707B2

(12) United States Patent
Grossmann

(10) Patent No.: US 9,364,707 B2
(45) Date of Patent: Jun. 14, 2016

(54) LATERAL GLIDE ELLIPTICAL EXERCISE MACHINE WITH YAW CONTROL

(71) Applicant: OCTANE FITNESS, LLC, Brooklyn Park, MN (US)

(72) Inventor: Brad H. Grossmann, Maplewood, MN (US)

(73) Assignee: Octane Fitness, LLC, Brooklyn Park, MN (US)

( * ) Notice: Subject to any disclaimer, the term of this patent is extended or adjusted under 35 U.S.C. 154(b) by 0 days.

(21) Appl. No.: 14/890,649

(22) PCT Filed: May 15, 2014

(86) PCT No.: PCT/US2014/038240

§ 371 (c)(1),
(2) Date: Nov. 12, 2015

(87) PCT Pub. No.: WO2014/186600

PCT Pub. Date: Nov. 20, 2014

(65) Prior Publication Data

US 2016/0089562 A1 Mar. 31, 2016

Related U.S. Application Data

(60) Provisional application No. 61/823,497, filed on May 15, 2013.

(51) Int. Cl.

| | |
|---|---|
| ***A63B 22/04*** | (2006.01) |
| ***A63B 22/00*** | (2006.01) |
| ***A63B 22/06*** | (2006.01) |
| ***A63B 23/04*** | (2006.01) |

(52) U.S. Cl.

CPC ..... *A63B 22/0015* (2013.01); *A63B 21/4047* (2015.10); *A63B 21/4049* (2015.10); *A63B 22/0664* (2013.01); *A63B 23/04* (2013.01); *A63B 2022/0676* (2013.01)

(58) Field of Classification Search

USPC ..... 482/1–148

See application file for complete search history.

(56) References Cited

U.S. PATENT DOCUMENTS

| | | | | |
|---|---|---|---|---|
| 5,284,460 | A * | 2/1994 | Miller | A63B 21/151 482/145 |
| 5,924,963 | A * | 7/1999 | Maresh | A63B 22/001 482/51 |
| 5,967,944 | A * | 10/1999 | Vittone | A63B 22/001 482/37 |
| 6,849,032 | B2 * | 2/2005 | Chu | A63B 22/001 482/51 |
| 7,591,762 | B2 * | 9/2009 | Chang | A63B 22/001 482/52 |
| 7,608,019 | B1 * | 10/2009 | Stearns | A63B 22/001 482/52 |
| 7,981,007 | B1 * | 7/2011 | Chu | A63B 21/225 482/52 |
| 8,062,186 | B2 * | 11/2011 | Nelson | A63B 22/0664 482/52 |
| 8,167,778 | B2 * | 5/2012 | Lai | A63B 21/0087 482/147 |
| 8,206,271 | B2 * | 6/2012 | Chu | A63B 21/225 482/52 |

(Continued)

*Primary Examiner* — Stephen Crow

(74) *Attorney, Agent, or Firm* — Sherrill Law Offices, PLLC

(57) ABSTRACT

A lateral glide stationary elliptical exercise device (10) with foot support platform (90) yaw control. Yaw control is achieved by a four bar dual rocker linkage yaw control mechanism that includes (i) a foot link (70) with a pair of laterally offset first (p5) and second (p9) connection points constrained to move through generally elliptical paths within parasagittal planes, (ii) a glide link (80) pivotably connected at a first end to the first connection point (p5), (iii) a drawbar (100) pivotably connected at a first end to the second connection point (p9), and (iv) a foot support platform (90) pivotably connected proximate a second end of the glide link (80) and proximate a second end of the drawbar (100).

8 Claims, 8 Drawing Sheets

(56) References Cited

U.S. PATENT DOCUMENTS 8,272,995 B2 * 9/2012 Stearns ..... A63B 22/001 482/52
8,444,580 B2 * 5/2013 Ochi ..... A61H 1/005 482/70
8,852,059 B1 * 10/2014 Stearns ..... A63B 22/001 482/52
2005/0272562 A1 * 12/2005 Alessandri ..... A63B 21/154 482/52
2006/0046902 A1 * 3/2006 Chang ..... A63B 22/0664 482/52
2007/0027001 A1 * 2/2007 Alessandri ..... A63B 21/005 482/51
2007/0167289 A1 * 7/2007 Alessandri ..... A63B 22/0069 482/51
2007/0225130 A1 * 9/2007 Maffei ..... A63B 21/154 482/71
2008/0132385 A1 * 6/2008 Alessandri ..... A63B 22/001 482/52

* cited by examiner

LATERAL GLIDE ELLIPTICAL EXERCISE MACHINE WITH YAW CONTROL

BACKGROUND

One type of stationary cardiovascular exercise equipment which has become extremely popular based predominantly upon its low-impact and natural motion is the elliptical exercise machine. A wide variety of elliptical exercise machines have been developed. Briefly, elliptical exercise machines typically include foot support platforms supported upon foot links with the foot links pivotally connected at a first end through a linkage system to a drive shaft for travel along a defined closed loop path (e.g., circular, elliptical, oval, etc.) and connected at the other end for reciprocating motion along a defined path as the first end travels along the closed loop path. This combination of looping and reciprocating paths of travel at opposite ends of the foot links impart an "elliptical" type motion to the foot support platforms attached to the foot links.

U.S. Pat. No. 7,513,854 issued to Steams et al. discloses an elliptical exercise machine in FIGS. 10-18 and associated textual disclosure, the disclosure of which is hereby incorporated by reference, that includes a lateral displacement component to the typical parasagittal elliptical path of travel.

The elliptical exercise machine with lateral displacement disclosed in the '854 patent provides a unique gait that can enhance the exerciser's experience by providing a different exercise motion. However, the lateral movement produced by the elliptical exercise machine disclosed in the '854 patent tends to result in an undesired yaw of the foot pads (i.e., rotation of the foot pads about a vertical or yaw axis of the foot pad), such as depicted in FIGS. 12 and 16 in the '854 patent.

Hence, a substantial need exists for an elliptical exercise machine with foot pads capable of yaw controlled lateral glide as the foot pads travel along a closed loop.

SUMMARY OF THE INVENTION

A first aspect of the invention is a stationary elliptical exercise device with a lateral glide component to the elliptical path of travel and a foot support platform yaw control mechanism. The exercise device includes (a) a frame, and (b) left and right foot supporting linkages, each including a four bar dual rocker linkage that includes (i) a foot link operably supported on the frame for movement of a pair of laterally offset first and second connection points on the foot link through generally elliptical paths within parasagittal planes, (ii) a glide link pivotably connected at a first end to the first connection point on the foot link for lateral pivoting about a first transverse pivot axis, and operably constrained for coordinated pivoting about the first transverse pivot axis as the first connection point moves along the generally elliptical path, (iii) a drawbar pivotably connected at a first end to the second connection point on the foot link for lateral pivoting about a second transverse pivot axis, and (iv) a foot support platform pivotably connected proximate a second end of the guide link and proximate a second end of the drawbar at laterally offset third and fourth connection points on the foot support platform for lateral pivoting about a third and a fourth transverse pivot axis respectively, whereby yawing of the foot support platform is reduced by the drawbar as the first and second connection points on the foot link travel along the generally elliptical paths.

DETAILED DESCRIPTION OF A PREFERRED EMBODIMENT

Nomenclature

| | |
|---|---|
| 10 | Exercise Device |
| 20 | Frame |
| 30 | Drive Shaft |
| 40 | Extension Elements or Cranks (Collectively) |
| 40r | Right Extension Element |
| 40s | Left Extension Element |
| 50 | Flywheel |
| 60 | Rocker Links (Collectively) |
| 60r | Right Rocker Link |
| 60s | Left Rocker Link |
| 70 | Foot Links (Collectively) |
| 70r | Right Foot Link |
| 70s | Left Foot Link |
| 80 | Lateral Glide Links (Collectively) |
| 80r | Right Lateral Glide Link |
| 80s | Left Lateral Glide Link |
| 90 | Foot Support Platforms (Collectively) |
| 90r | Right Foot Support Platform |
| 90s | Left Foot Support Platform |
| 100 | Glide Link Drawbars (Collectively) |
| 100r | Right Glide Link Drawbar |
| 100s | Left Glide Link Drawbar |
| 110 | Foot Support Platform Drawbars (Collectively) |
| 110r | Right Foot Support Platform Drawbar |
| 110s | Left Foot Support Platform Drawbar |
| 120 | Arm Links (Collectively) |
| 120r | Right Arm Link |
| 120s | Left Arm Link |
| 130 | Intermediate Links (Collectively) |
| 130r | Right Intermediate Link |
| 130s | Left Intermediate Link |
| 150 | Brake and Braking Control System |
| 200 | Pivot Point Repositioning Unit (Drawbar-Rocker Pivot Point) (Collectively) |
| 200r | Right Pivot Point Repositioning Unit |
| 200s | Left Pivot Point Repositioning Unit |
| 201 | Guide Shafts (Collectively) |
| 201r | Right Guide Shafts |
| 201s | Left Guide Shafts |
| 202 | Carriages (Collectively) |
| 202r | Right Carriage |
| 202s | Left Carriage |
| 203 | Linear Actuators (Collectively) |
| 203r | Right Linear Actuator |
| 203s | Left Linear Actuator |
| 204 | Lead Screws (Collectively) |
| 204r | Right Lead Screw |
| 204s | Left Lead Screw |
| p1 | Drive Shaft - Crank Pivot Axis |
| p2 | Crank - Foot Link Pivot Axis |
| p3 | Foot Link - Rocker Pivot Axis |
| p4 | Rocker - Frame Pivot Axis |
| p5 | Foot Link - Glide Link Pivot Axis |

-continued

| | |
|---|---|
| p6 | Rocker - GL Drawbar Multi-Axis Pivot Point |
| p7 | Glide Link - GL Drawbar Multi-Axis Pivot Point |
| p8 | Glide Link - Foot Support Platform Pivot Axis |
| p9 | Foot Link - FS Drawbar Pivot Axis |
| p10 | Foot Support Platform - FS Drawbar Pivot Axis |
| p11 | Foot Support Platform - Intermediate Link Multi-Axis Pivot Point |
| p12 | Intermediate Link - Arm Link Multi-Axis Pivot Point |
| p13 | Arm Link - Frame Pivot Axis |
| x | Lateral Axis |
| y | Longitudinal Axis |
| z | Transverse Axis |

Construction

Figure 1:
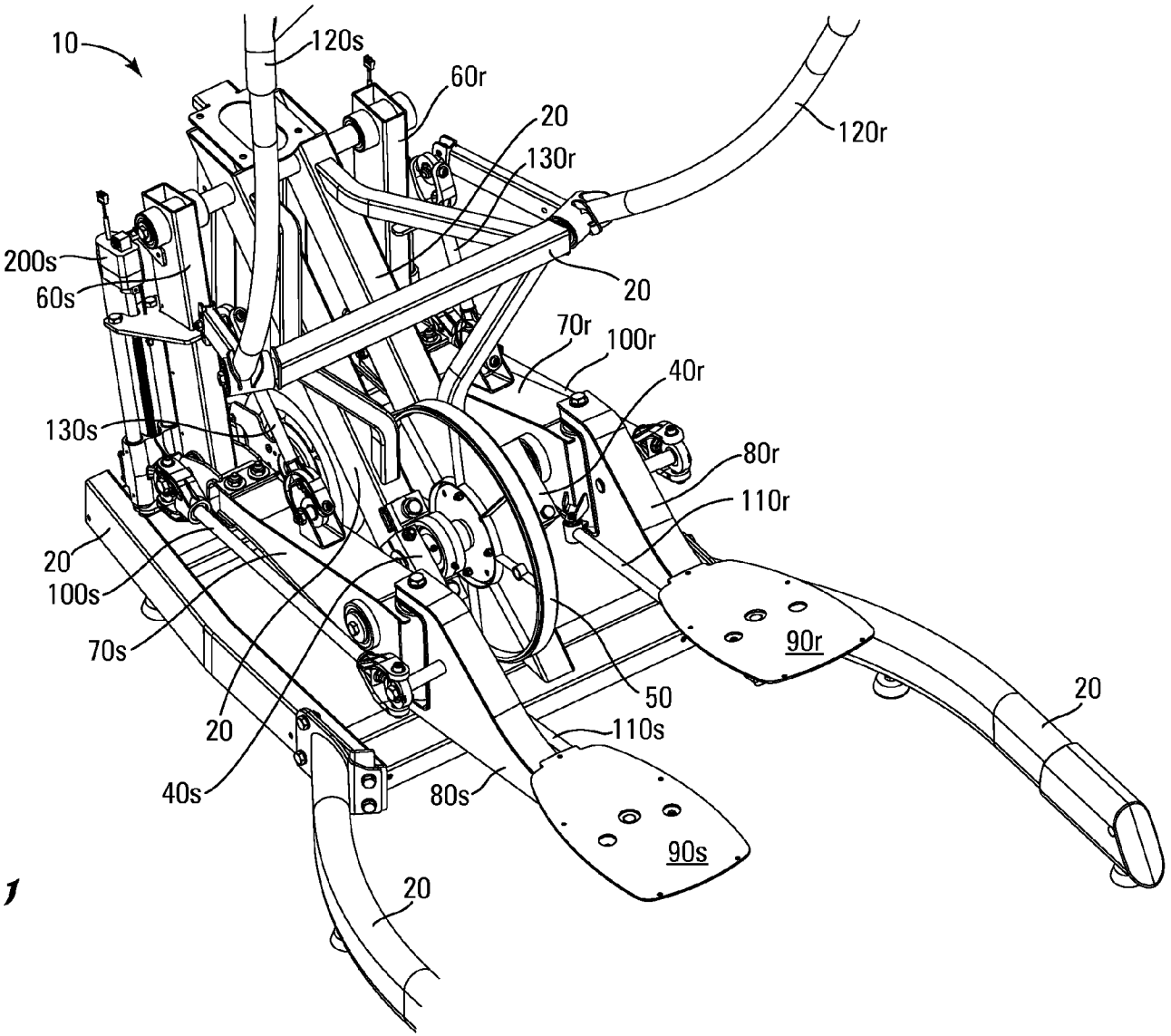
FIG. 1 is an isometric view of one embodiment of the present invention with the left and right drawbars position along the length of the rocker link to effect a smaller lateral glide.
Figure 2:
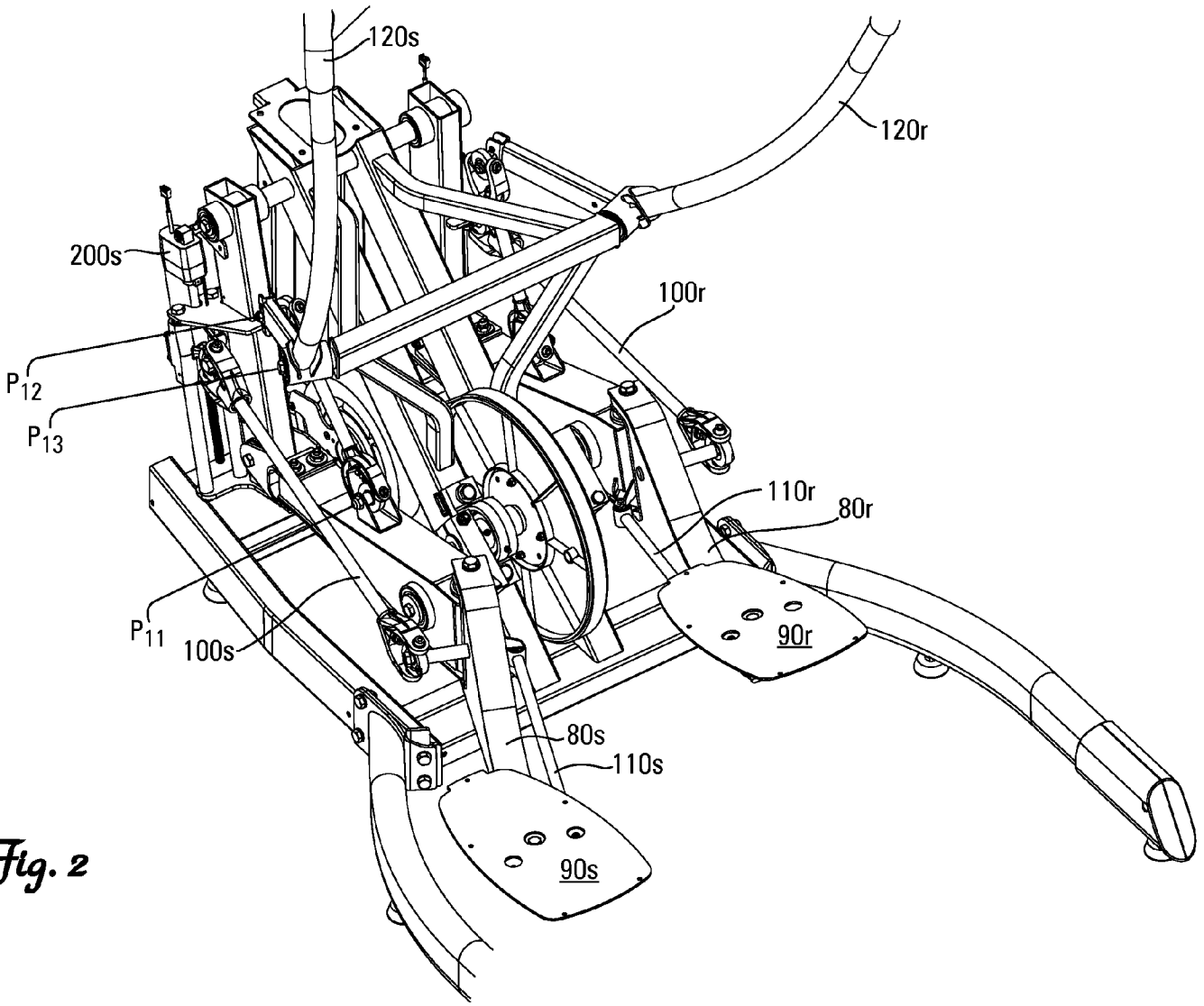
FIG. 2 is an isometric view of the invention depicted in FIG. 1 but with the left and right drawbars position along the length of the rocker link to effect a larger lateral glide.
Figure 3:
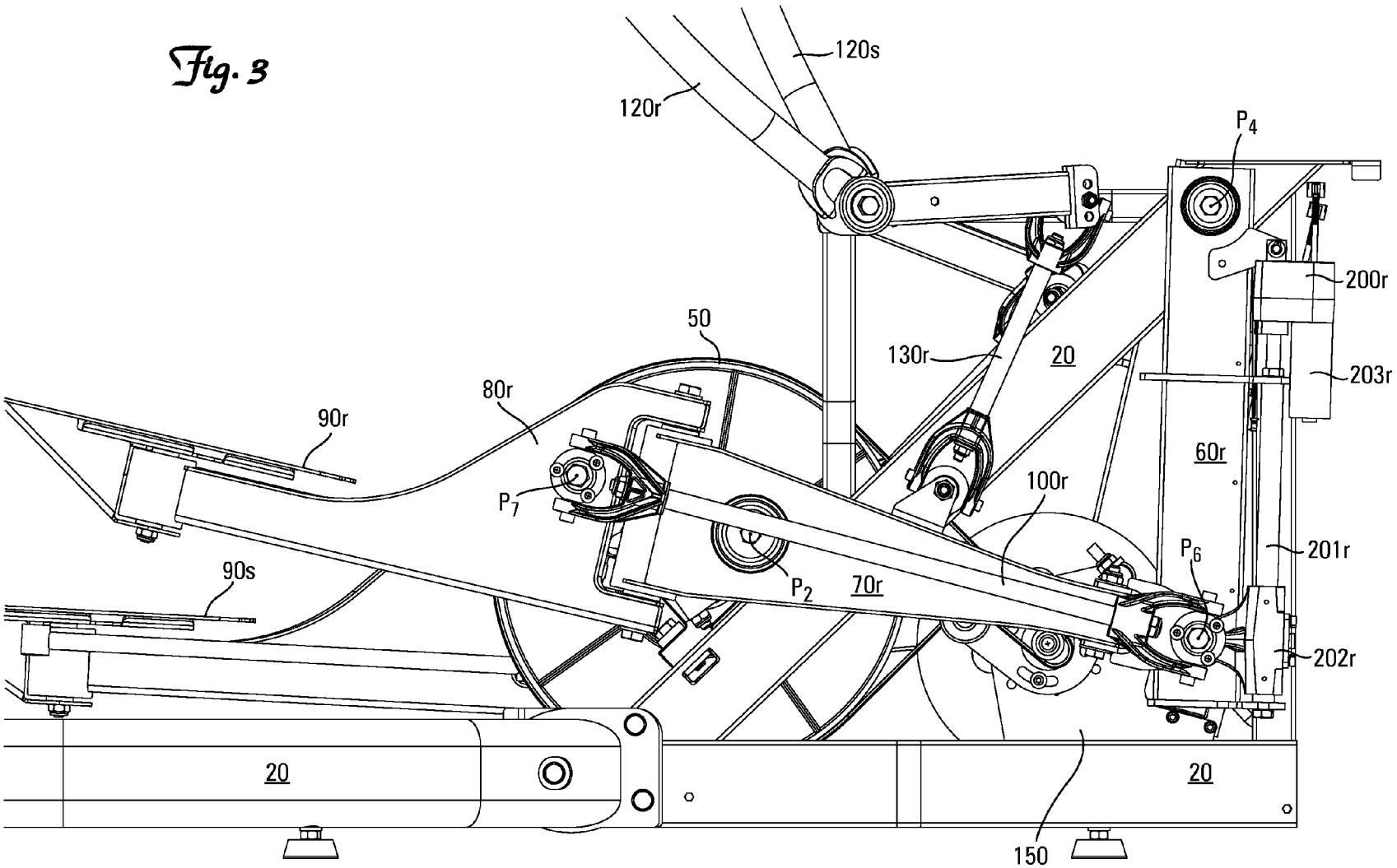
FIG. 3 is a side view of the invention depicted in FIG. 1.
Figure 4:
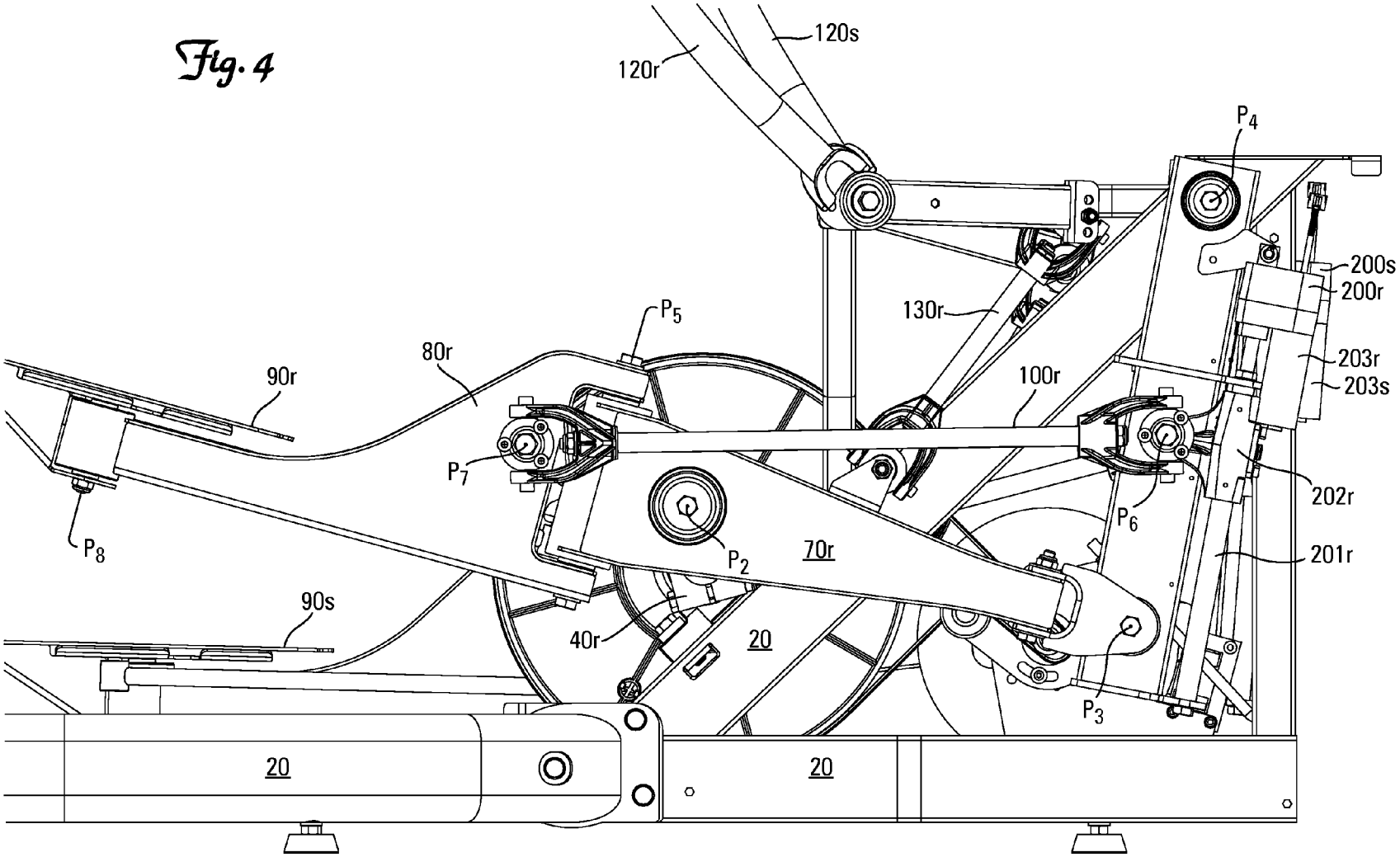
FIG. 4 is a side view of the invention depicted in FIG. 2.
Figure 5:
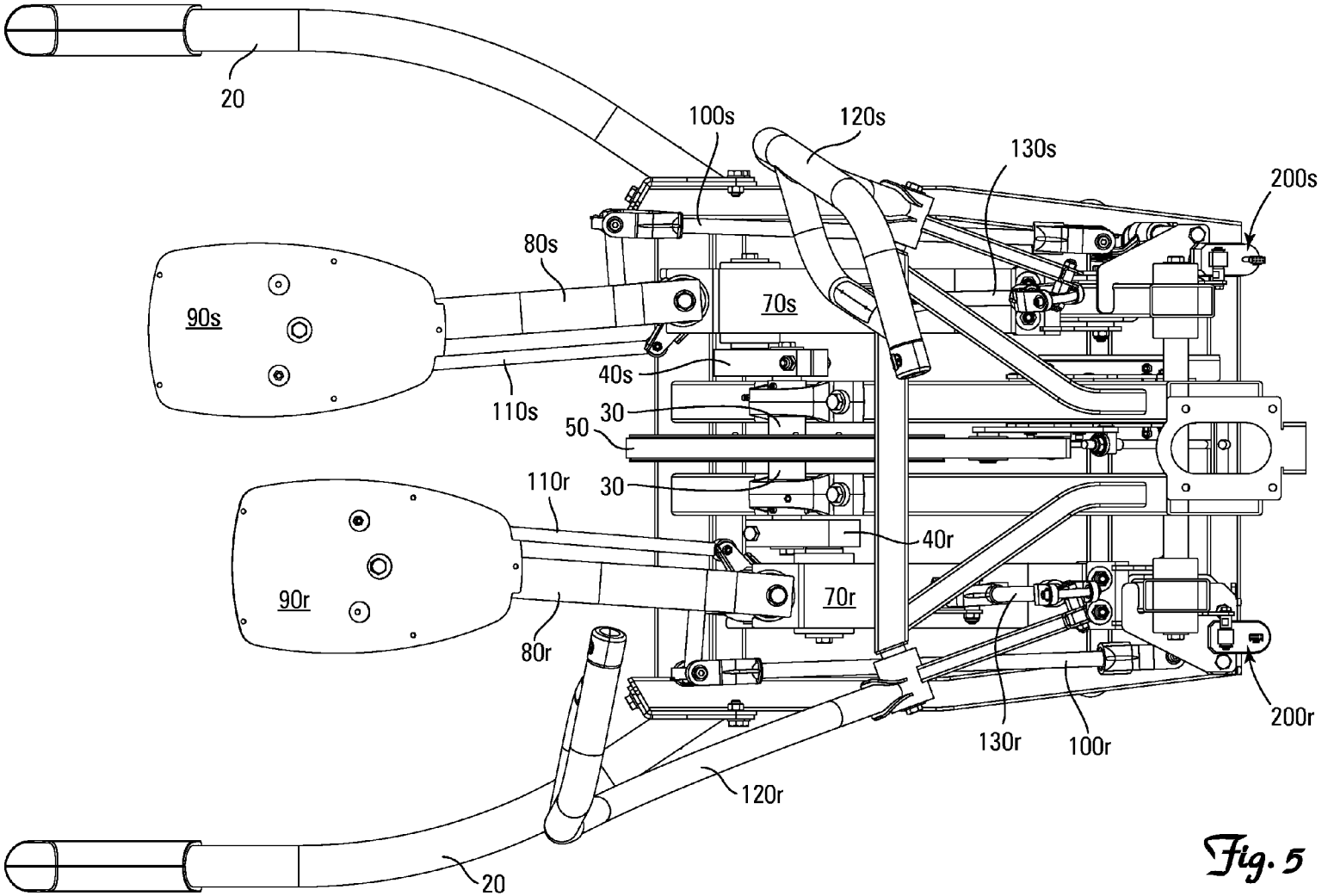
FIG. 5 is a plan view of the invention depicted in FIG. 1.
Figure 6:
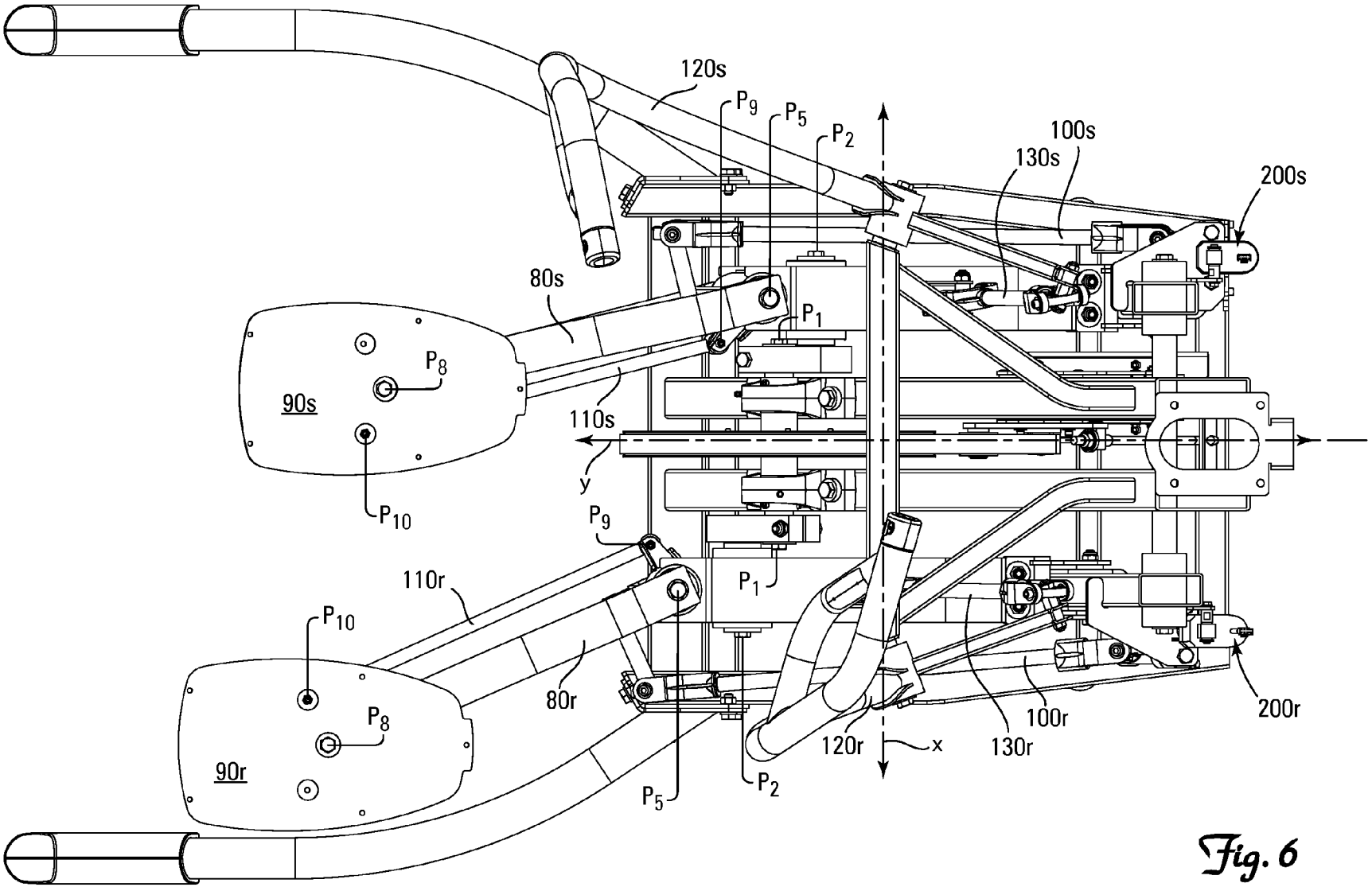
FIG. 6 is a plan view of the invention depicted in FIG. 2.
Figure 7:
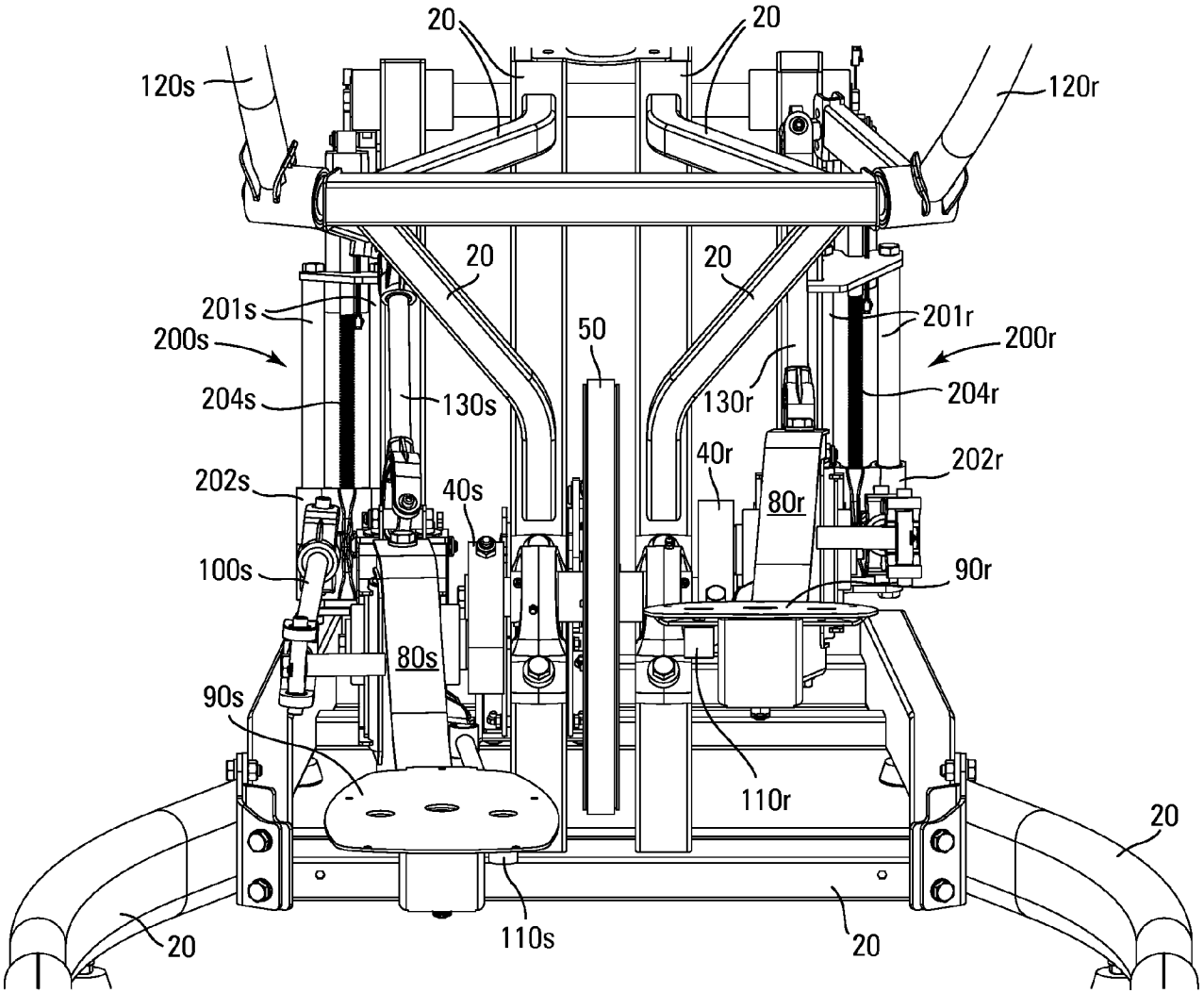
FIG. 7 is an end view of the invention depicted in FIG. 1.
Figure 8:
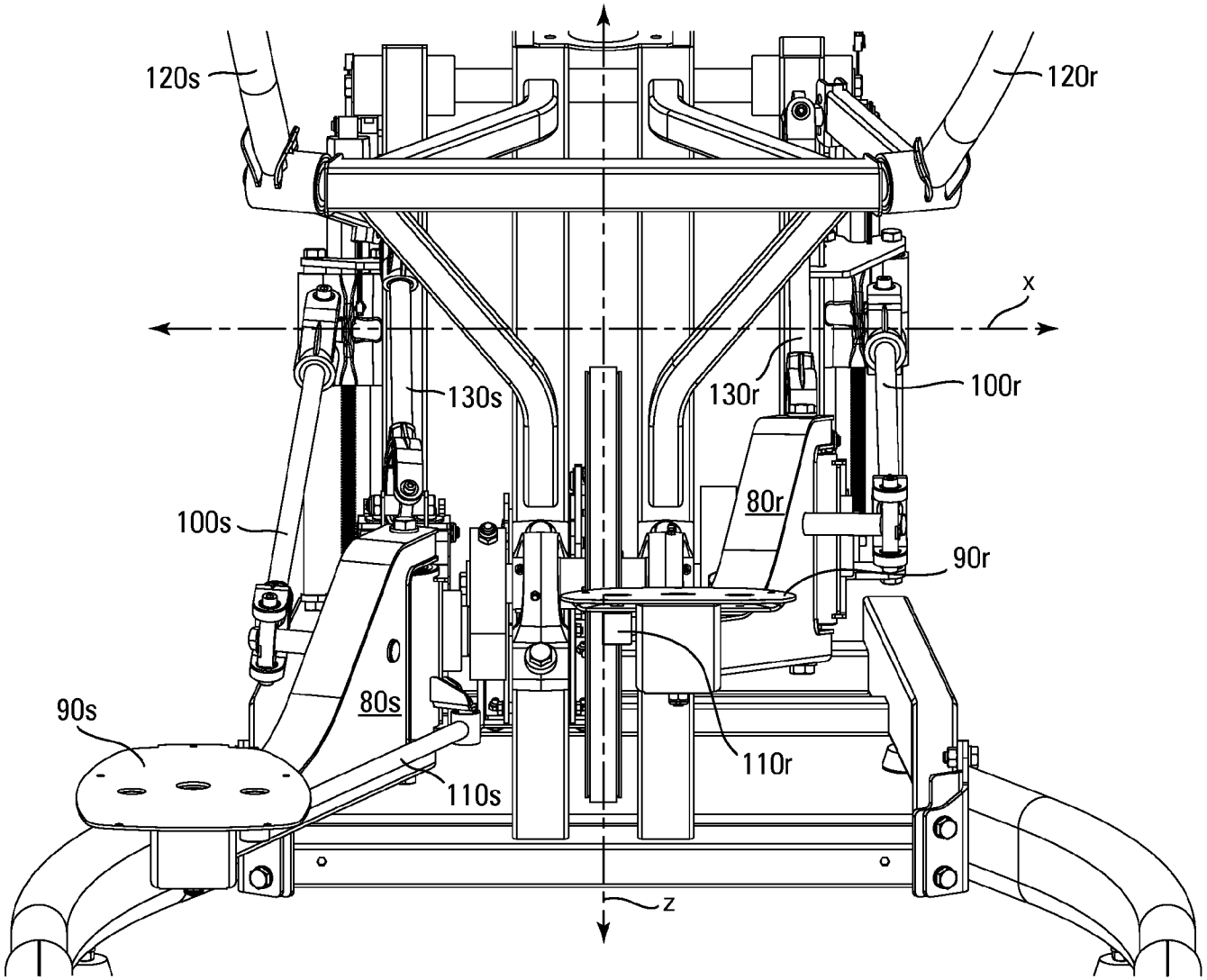
FIG. 8 is an end view of the invention depicted in FIG. 2.

As shown in FIGS. 1-8, the invention is an exercise device 10 including at least (i) a frame 20 defining lateral x, longitudinal y and transverse z axes, and (ii) left and right foot supporting linkages (not collectively numbered), each including a four bar dual rocker linkage (not collectively numbered) that includes a foot link 70, a glide link 80, a foot support platform 90 and a foot support platform drawbar (FSP drawbar) 110, all configured and arranged so that the FSP drawbar 110 can reduce yawing of each foot support platform 90 about its yaw axis as the glide link 80 and foot support platform 90 travel laterally x relative to the longitudinal axis y of the exercise device 10.

The frame 20 includes a base (not separately numbered) for stably supporting the exercise device 10 on a floor (not shown), and a plurality of stiles, rails, stanchions and other supporting members (not separately numbered) as necessary and appropriate to operably support the components of the exercise device 10.

A drive shaft 30 is supported by the frame 20 for rotation about a lateral pivot axis $p_1$. Left and right extension elements 40*r* and 40*s* (collectively extension elements 40) are rigidly attached to opposite ends of the drive shaft 30 and extend substantially orthogonally from the drive shaft 30. A variety of suitable extension elements 40 are known to those skilled in the art, including specifically, but not exclusively, bent end portions of the drive shaft, crank arms, etc.

When the extension elements 40 are crank arms 40 each crank arm 40 has a first end rigidly attached proximate a lateral x end of the drive shaft 30 for imparting rotational motion of the crank arms 40 about the lateral pivot axis $p_1$ of the drive shaft 30 and interlocking the crank arms 40.

When the extension element 40 is a drive pulley (not shown) the drive pulley is rigidly attached to the drive shaft 30 at the center of the drive pulley for imparting rotational motion of the drive pulley about the lateral pivot axis $p_1$ of the drive shaft 30.

Right and left lateral glide links 80*r* and 80*s* (collectively lateral glide links 80) are supported upon right and left foot links 70*r* and 70*s* (collectively foot links 70) respectively, at connection points effective for allowing lateral x pivoting of the lateral glide links 80 about a transversely z extending pivot axis $p_5$ relative to the foot link 70 and relative to the longitudinal axis y of the frame 20. The lateral glide links 80 may be supported upon the respective foot link 70 at any point along the length of the foot link 70 so long as the foot link 70 moves in a closed loop path at the point of connection.

The foot links 70 may be associated with the frame 20 in a variety of different ways to accomplish and impart the necessary closed loop path of travel to the point at which the lateral glide links 80 connect to the foot links 70. Exemplary connective structures and arrangements are disclosed in U.S. Pat. No. 3,316,898 issued to Brown, U.S. Pat. No. 5,242,343 issued to Miller, U.S. Pat. No. 5,352,169 issued to Eschenbach, U.S. Pat. No. 5,383,829 issued to Miller, U.S. Pat. No. 5,423,729 issued to Eschenbach, U.S. Pat. No. 5,518,473 issued to Miller, U.S. Pat. No. 5,529,554 issued to Eschenbach, U.S. Pat. No. 5,562,574 issued to Miller, U.S. Pat. No. 5,577,985 issued to Miller, U.S. Pat. No. 5,611,756 issued to Miller, U.S. Pat. No. 5,685,804 issued to Whan-Tong et al., U.S. Pat. No. 5,692,994 issued to Eschenbach, U.S. Pat. No. 5,707,321 issued to Maresh, U.S. Pat. No. 5,725,457 issued to Maresh, U.S. Pat. No. 5,735,774 issued to Maresh, U.S. Pat. No. 5,755,642 issued to Miller, U.S. Pat. No. 5,788,609 issued to Miller, U.S. Pat. No. 5,788,610 issued to Eschenbach, U.S. Pat. No. 5,792,026 issued to Maresh et al., U.S. Pat. No. 5,803,871 issued to Stearns et al., U.S. Pat. No. 5,836,854 issued to Kuo, U.S. Pat. No. 5,836,855 issued to Eschenbach, U.S. Pat. No. 5,846,166 issued to Kuo, U.S. Pat. No. 5,848,954 issued to Steams et al., U.S. Pat. No. 5,857,941 issued to Maresh et al., U.S. Pat. No. 5,876,307 issued to Steams et al., U.S. Pat. No. 5,876,308 issued to Jarvie, U.S. Pat. No. 5,879,271 issued to Stearns et al., U.S. Pat. No. 5,882,281 issued to Steams et al., U.S. Pat. No. 5,882,281 issued to Stearns et al., U.S. Pat. No. 5,893,820 issued to Maresh et al., U.S. Pat. No. 5,895,339 issued to Maresh, U.S. Pat. No. 5,897,463 issued to Maresh, U.S. Pat. No. 5,911,649 issued to Miller, U.S. Pat. No. 5,916,064 issued to Eschenbach, U.S. Pat. No. 5,919,118 issued to Stearns et al., U.S. Pat. No. 5,921,894 issued to Eschenbach, U.S. Pat. No. 5,924,963 issued to Maresh et al., U.S. Pat. No. 5,935,046 issued to Maresh, U.S. Pat. No. 5,938,568 issued to Maresh et al., U.S. Pat. No. 5,938,570 issued to Maresh, U.S. Pat. No. 5,947,872 issued to Eschenbach, U.S. Pat. No. 5,957,814 issued to Eschenbach, U.S. Pat. No. 5,993,359 issued to Eschenbach, U.S. Pat. No. 5,997,445 issued to Maresh et al., U.S. Pat. No. 6,126,574 issued to Stearns et al., U.S. Pat. No. 6,248,044 issued to Stearns et al., U.S. Pat. No. 6,024,676 issued to Eschenbach, U.S. Pat. No. 6,027,430 issued to Steams et al., U.S. Pat. No. 6,027,431 issued to Stearns et al., U.S. Pat. No. 6,030,320 issued to Steams et al., U.S. Pat. No. 6,042,512 issued to Eschenbach, U.S. Pat. No. 6,045,487 issued to Miller, U.S. Pat. No. 6,045,488 issued to Eschenbach, U.S. Pat. No. 6,053,847 issued to Steams et al., U.S. Pat. No. 6,063,009 issued to Stearns et al., U.S. Pat. No. 6,077,196 issued to Eschenbach, U.S. Pat. No. 6,077,197 issued to Stearns et al., U.S. Pat. No. 6,077,198 issued to Eschenbach, U.S. Pat. No. 6,080,086 issued to Stearns et al., U.S. Pat. No. 6,083,143 issued to Maresh, U.S. Pat. No. 6,090,013 issued to Eschenbach, U.S. Pat. No. 6,090,014 issued to Eschenbach, U.S. Pat. No. 6,099,439 issued to Eschenbach, U.S. Pat. No. 6,113,518 issued to Maresh et al., U.S. Pat. No. 6,123,650 issued to Birrell, U.S. Pat. No. 6,135,923 issued to Steams et al., U.S. Pat. No. 6,142,915 issued to Eschenbach, U.S. Pat. No. 6,146,313 issued to Whan-Tong et al., U.S. Pat. No. 6,165,107 issued to Birrell, U.S. Pat. No. 6,168,552 issued to Eschenbach, U.S. Pat. No. 6,171,215 issued to Steams et al., U.S. Pat. No. 6,171,217 issued to Cutler, U.S. Pat. No. 6,176,814 issued to Eschenbach, U.S. Pat. No. 6,183,397 issued to Stearns et al., U.S. Pat. No. 6,183,398 issued to Rufino et al., U.S. Pat. No. 6,190,289 issued to Pyles et al., U.S. Pat. No. 6,196,948 issued to Stearns et al., U.S. Pat. No. 6,206,804 issued to Maresh, U.S. Pat. No. 6,210,305 issued to Eschenbach, U.S. Pat. No. 6,217,485 issued to Maresh, U.S. Pat. No. 6,248,045 issued to Stearns et al., U.S. Pat. No. 6,248,046 issued to Maresh et al., U.S. Pat. No. 6,254,514 issued to Maresh et al., U.S. Pat. No. 6,277,054 issued to Kuo, U.S. Pat. No. 6,283,895 issued to Stearns et al., U.S. Pat. No. 6,302,825 issued to Steams et al., U.S. Pat. No. 6,312,362 issued to Maresh et al., U.S. Pat. No. 6,338,698 issued to Stearns et al., U.S. Pat. No. 6,340,340 issued to Steams et al., U.S. Pat. No.

6,361,476 issued to Eschenbach, U.S. Pat. No. 6,387,017 issued to Maresh, U.S. Pat. No. 6,390,953 issued to Maresh et al., U.S. Pat. No. 6,398,695 issued to Miller, U.S. Pat. No. 6,409,632 issued to Eschenbach, U.S. Pat. No. 6,409,635 issued to Maresh et al., U.S. Pat. No. 6,416,442 issued to Steams et al., U.S. Pat. No. 6,422,976 issued to Eschenbach, U.S. Pat. No. 6,422,977 issued to Eschenbach, U.S. Pat. No. 6,436,007 issued to Eschenbach, U.S. Pat. No. 6,440,042 issued to Eschenbach, U.S. Pat. No. 6,454,682 issued to Kuo, U.S. Pat. No. 6,461,277 issued to Maresh et al., U.S. Pat. No. 6,482,130 issued to Pasero et al., U.S. Pat. No. 6,482,132 issued to Eschenbach, U.S. Pat. No. 6,500,096 issued to Farney, U.S. Pat. No. 6,527,677 issued to Maresh, U.S. Pat. No. 6,527,680 issued to Maresh, U.S. Pat. No. 6,540,646 issued to Steams et al., U.S. Pat. No. 6,544,146 issued to Stearns et al., U.S. Pat. No. 6,547,701 issued to Eschenbach, U.S. Pat. No. 6,551,217 issued to Kaganovsky, U.S. Pat. No. 6,551,218 issued to Goh, U.S. Pat. No. 6,554,750 issued to Stearns et al., U.S. Pat. No. 6,565,486 issued to Steams et al., U.S. Pat. No. 6,569,061 issued to Stearns et al., U.S. Pat. No. 6,575,877 issued to Rufino et al., U.S. Pat. No. 6,579,210 issued to Steams et al., U.S. Pat. No. 6,612,969 issued to Eschenbach, U.S. Pat. No. 6,629,909 issued to Stearns et al., and United States Patent Application Publication Nos. 2001/0011053 filed by Miller, 2001/0051562 filed by Steams et al., 2002/0019298 filed by Eschenbach, 2002/0055420 filed by Steams et al., 2002/0128122 filed by Miller, 2002/0142890 filed by Ohrt et al., 2002/0155927 filed by Corbalis et al., 2003/0022763 filed by Eschenbach, which disclosure is hereby incorporated by reference.

One suitable connecting system depicted in FIGS. 1-8 has (i) left and right rocker links 60*r* and 60*s* (collectively rocker links 60) pivotally attached at a first end to the frame 20 at a pivot axis $p_4$, (ii) a first end portion of each foot link 70 pivotally attached to a distal end of an associated crank arm 40 at a pivot axis $p_1$ spaced from the pivot axis $p_1$ of the drive shaft 30 for travel along a closed loop path relative to the pivot axis $p_1$ of the drive shaft 30, and (iii) a second end portion of each foot link 70 pivotally attached to a second end of an associated rocker link 60 at a pivot axis $p_3$. Other embodiments are possible.

Left and right glide link drawbars 100*r* and 100*s* (collectively glide link drawbars (GL drawbars) 100) interconnect the right and left glide links 80*r* and 80*s* to the associated rocker link 60 via multi-axis joints at pivot points $p_7$ and $p_6$ respectively. The GL drawbars 100 control the extent to which the glide links 80 pivot laterally x about pivot axis $p_5$ relative to the associated foot link 70.

Left and right foot support platforms 90*r* and 90*s* (collectively foot support platforms 90) are pivotably attached to the right and left glide links 80*r* and 80*s* respectively, for pivoting about pivot axis $p_8$. Left and right foot support platform drawbars 110*r* and 100*s* (collectively foot support platform drawbars (FSP drawbars) 110) interconnect the left and right foot support platforms 90*r* and 90*s* to their respective foot link 70 via multi-axis joints at pivot axes $p_{10}$ and $p_9$ respectively. Pivot axes $p_9$ and $p_{10}$ are laterally x offset from pivot axes $p_5$ and $p_8$ respectively. Each FSP drawbar 110 forms a four bar dual rocker linkage with the associated foot link 70, glide link 80 and foot support platform 90 to control and limit the extent to which the foot support platform 90 pivots laterally x about pivot axis $p_1$ relative to the associated foot link 70 and relative to the longitudinal axis y of the frame 20 as the glide links 80 and foot support platforms 90 travel along the closed loop path, thereby effectively restricting yawing of each foot support platform 90 about its yaw axis.

The exercise device 10 preferably includes a system attached to the frame 20 and in communication with the left and right foot support platform linkages for exerting a controlled variable resistive force against movement of the foot support platforms 90 along the closed loop path of travel, such as a brake and braking control system 150 with or without a flywheel. A separate resistance device can be provided for each foot support platform 90. Many types of resistance devices are known such as pivoting devices, sliding devices, weights on cables or levers, braking motors, generators, brushless generators, eddy current systems, magnetic systems, alternators, tightenable belts, friction rollers, water wheels, paddles, etc., any of which could be effectively utilized in the present invention. Exemplary resistance devices suitable for use in this invention include those disclosed in U.S. Pat. No. 5,423,729 issued to Eschenbach, U.S. Pat. No. 5,685,804 issued to Whan-Tong et al., U.S. Pat. No. 5,788,610 issued to Eschenbach, U.S. Pat. No. 5,836,854 issued to Kuo, U.S. Pat. No. 5,836,855 issued to Eschenbach, U.S. Pat. No. 5,846,166 issued to Kuo, U.S. Pat. No. 5,895,339 issued to Maresh, U.S. Pat. No. 5,947,872 issued to Eschenbach, U.S. Pat. No. 5,957,814 issued to Eschenbach, U.S. Pat. No. 6,042,512 issued to Eschenbach, U.S. Pat. No. 6,053,847 issued to Stearns et al., U.S. Pat. No. 6,090,013 issued to Eschenbach, U.S. Pat. No. 6,146,313 issued to Whan-Tong et al., U.S. Pat. No. 6,217,485 issued to Maresh, U.S. Pat. No. 6,409,632 issued to Eschenbach, U.S. Pat. No. 6,482,130 issued to Pasero et al., U.S. Pat. No. 6,544,146 issued to Stearns et al., U.S. Pat. No. 6,575,877 issued to Rufino et al., and U.S. Pat. No. 6,612,969 issued to Eschenbach, which disclosure is hereby incorporated by reference.

The exercise device 10 also preferably includes an inertial system attached to the frame 20 and in communication with the left and right foot supporting linkages. Such inertial systems are widely known and commonly utilized on stationary exercise equipment. Such inertial systems typically employ a flywheel (not separately numbered) keyed to rotation with the drive shaft 30.

A wide variety of systems effective for adjusting the size and or shape of the closed loop path traveled by the foot support platforms 90 by adjusting position of one or more of the pivot axes or pivot points about which an arm or link pivots as the foot support platforms 90 travel along the closed loop path of travel are known to those skilled in the art. Exemplary systems suitable for use in this invention are disclosed in U.S. Pat. No. 5,562,574 issued to Miller, U.S. Pat. No. 5,788,610 issued to Eschenbach, U.S. Pat. No. 5,836,854 issued to Kuo, U.S. Pat. No. 5,836,855 issued to Eschenbach, U.S. Pat. No. 5,882,281 issued to Steams et al., U.S. Pat. No. 5,893,820 issued to Maresh et al., U.S. Pat. No. 5,895,339 issued to Maresh, U.S. Pat. No. 5,919,118 issued to Steams et al., U.S. Pat. No. 5,921,894 issued to Eschenbach, U.S. Pat. No. 5,957,814 issued to Eschenbach, U.S. Pat. No. 5,993,359 issued to Eschenbach, U.S. Pat. No. 6,027,430 issued to Stearns et al., U.S. Pat. No. 6,027,431 issued to Steams et al., U.S. Pat. No. 6,030,320 issued to Stearns et al., U.S. Pat. No. 6,045,488 issued to Eschenbach, U.S. Pat. No. 6,053,847 issued to Stearns et al., U.S. Pat. No. 6,077,196 issued to Eschenbach, U.S. Pat. No. 6,077,197 issued to Steams et al., U.S. Pat. No. 6,077,198 issued to Eschenbach, U.S. Pat. No. 6,080,086 issued to Stearns et al., U.S. Pat. No. 6,090,013 issued to Eschenbach, U.S. Pat. No. 6,113,518 issued to Maresh et al., U.S. Pat. No. 6,135,923 issued to Steams et al., U.S. Pat. No. 6,171,215 issued to Stearns et al., U.S. Pat. No. 6,196,948 issued to Steams et al., U.S. Pat. No. 6,217,485 issued to Maresh, U.S. Pat. No. 6,248,044 issued to Stearns et al., U.S. Pat. No. 6,248,045 issued to Stearns et al., U.S. Pat.

No. 6,248,046 issued to Maresh et al., U.S. Pat. No. 6,254,514 issued to Maresh et al., U.S. Pat. No. 6,277,054 issued to Kuo, U.S. Pat. No. 6,283,895 issued to Steams et al., U.S. Pat. No. 6,334,836 issued to Segasby, U.S. Pat. No. 6,338,698 issued to Stearns et al., U.S. Pat. No. 6,361,476 issued to Eschenbach, U.S. Pat. No. 6,387,017 issued to Maresh, U.S. Pat. No. 6,390,953 issued to Maresh et al., U.S. Pat. No. 6,416,442 issued to Steams et al., U.S. Pat. No. 6,440,042 issued to Eschenbach, U.S. Pat. No. 6,450,925 issued to Kuo, U.S. Pat. No. 6,547,701 issued to Eschenbach, U.S. Pat. No. 6,554,750 issued to Steams et al., U.S. Pat. No. 6,565,486 issued to Stearns et al., U.S. Pat. No. 6,579,210 issued to Stearns et al., U.S. Pat. No. 6,612,969 issued to Eschenbach, U.S. Pat. No. 6,629,909 issued to Steams et al., and United States Patent Application Publication Nos. 2001/0051562 filed by Steams et al., 2002/0019298 filed by Eschenbach, 2002/0055420 filed by Steams et al., and 2002/0142890 filed by Ohrt et al., which disclosures are hereby incorporated by reference.

One embodiment of a manual repositioning system for adjusting lateral movement of the foot support platforms 90 is disclosed in U.S. Pat. No. 7,513,854 issued to Stearns et al. A powered version of such a repositioning system 200 is depicted in FIGS. 1-8. Briefly, the powered repositioning system 200 depicted in FIGS. 1-8 includes left and right pivot axes and pivot point repositioning units 200*r* and 200*s* (collectively pivot point repositioning units 200), each of which permits repositioning of each rocker-GL drawbar pivot point $p_6$ along the length of the associated rocker link 60 based upon a control signal, by pivotably attaching the GL drawbar 100 onto an carriage 202 capable of being repositioned along the length of a pair of guide shafts 201 by an actuator 203 driven lead screw 204.

Systems provided on the exercise machine 10 for adjusting the size and/or shape of the closed loop path traveled by the foot support platforms 90 by adjusting the position of one or more of the pivot axes $p_2$ through $p_{10}$ can be automatically controlled by an onboard or remotely located microcontroller or processor based upon preprogrammed parameters, or can interface with and be controlled by input from a user interface panel (not shown) as is typical for stationary exercise equipment.

I claim:

1. A stationary elliptical exercise device comprising:

(a) a frame defining a longitudinally and transversely extending sagittal plane, and (b) left and right foot supporting linkages, each including a four bar dual rocker linkage that includes:

(i) a foot link operably supported on the frame for movement of a pair of laterally offset first and second connection points on the foot link through generally elliptical paths within parasagittal planes, (ii) a glide link pivotably connected at a first end to the first connection point on the foot link for pivoting about a first transverse pivot axis, and operably constrained for coordinated pivoting about the first transverse pivot axis as the first connection point moves along the generally elliptical path, (iii) a drawbar pivotably connected at a first end to the second connection point on the foot link for pivoting about a second transverse pivot axis, and (iv) a foot support platform pivotably connected proximate a second end of the glide link and proximate a second end of the drawbar at laterally offset third and fourth connection points on the foot support platform for pivoting about a third and a fourth transverse pivot axis respectively, (v) whereby yawing of the foot support platform about a yaw axis of the foot support platform is reduced by the drawbar as the first and second connection points of the foot link travel along the respective generally elliptical paths.

2. The stationary elliptical exercise device of claim 1 wherein (a) each foot link has a first end and a second end, (b) each glide link is pivotably connected to one of the foot links proximate the second end of the foot link, and (c) the first end of each foot link is pivotable about an alpha lateral pivot axis, and wherein the exercise device further includes at least (A) a drive shaft rotatably attached to the frame, and (B) first and second crank arms having first and second ends, with each of the crank arms attached proximate the first end to the drive shaft and pivotally attached proximate the second end to one of the foot links at a crank pivot point which is positioned intermediate the alpha lateral pivot axis and the first connection pivot point.

3. The stationary elliptical exercise device of claim 1 wherein each of the foot support platforms travel along a respective path as the first and second connection points on the foot link move through the generally elliptical paths, and the exercise device further includes at least a means effective for exerting a resistive force against movement of the foot support platforms along their respective path.

4. The stationary elliptical exercise device of claim 2 wherein each of the foot support platforms travel along a respective path as the first and second connection points on the foot link move through the generally elliptical paths, and the exercise device further includes at least a means effective for exerting a resistive force against movement of the foot support platforms along their respective path.

5. The stationary elliptical exercise device of claim 3 further including at least a means for adjusting the path traveled by each of the foot support platforms.

6. The stationary elliptical exercise device of claim 4 further including at least a means for adjusting the path traveled by each of the foot support platforms.

7. The stationary elliptical exercise device of claim 6 wherein the means for adjusting the path traveled by each of the foot support platforms is a means for transversely repositioning each alpha lateral pivot axis relative to the drive shaft.

8. The stationary elliptical exercise device of claim 7 wherein the means for adjusting the path traveled by each of the foot support platforms is a powered repositioning system selectively actuated by a user.

* * * * *